US008887462B2

(12) United States Patent
Tatari

(10) Patent No.: US 8,887,462 B2
(45) Date of Patent: Nov. 18, 2014

(54) PREFABRICATED TILE SYSTEM WITH MODULAR BACKING BOARD

(71) Applicant: Ali Tatari, Alexandria, VA (US)

(72) Inventor: Ali Tatari, Alexandria, VA (US)

( * ) Notice: Subject to any disclaimer, the term of this patent is extended or adjusted under 35 U.S.C. 154(b) by 0 days.

(21) Appl. No.: 13/972,430

(22) Filed: Aug. 21, 2013

(65) Prior Publication Data

US 2014/0053487 A1 Feb. 27, 2014

Related U.S. Application Data

(63) Continuation of application No. 61/691,418, filed on Aug. 21, 2012.

(51) Int. Cl.
*E04F 13/08* (2006.01)
*E04F 13/09* (2006.01)

(52) U.S. Cl.
CPC ..... *E04F 13/09* (2013.01); *E04F 13/0803* (2013.01); *E04F 13/0862* (2013.01)
USPC ..... 52/386; 52/384; 52/385; 52/387; 52/388; 52/389

(58) Field of Classification Search
CPC ... E04F 13/08; E04F 15/02; E04F 2201/0115; E04F 13/07
USPC ..... 52/384–389
See application file for complete search history.

(56) References Cited

U.S. PATENT DOCUMENTS

| | | | | |
|---|---|---|---|---|
| 629,100 | A | 7/1899 | Blanchard | |
| 957,189 | A | 5/1910 | Chappell | |
| 1,701,454 | A | 2/1929 | Knowlton | |
| RE19,518 | E | 4/1935 | Chaffee | |
| 2,738,825 | A | 3/1956 | McElroy | |
| 3,444,660 | A | 5/1969 | Feichter et al. | |
| 4,554,769 | A | 11/1985 | Fujii et al. | |
| 4,773,201 | A * | 9/1988 | Trezza | 52/510 |
| 5,362,560 | A * | 11/1994 | Ehrhart et al. | 428/343 |
| 6,330,774 | B1 | 12/2001 | Weinstein | |
| 7,197,855 | B2 * | 4/2007 | Della Pepa | 52/460 |
| 7,614,193 | B2 * | 11/2009 | Turner et al. | 52/385 |
| 7,984,600 | B2 * | 7/2011 | Alford et al. | 52/588.1 |
| 8,156,705 | B2 * | 4/2012 | Alford et al. | 52/588.1 |
| 2004/0093819 | A1 | 5/2004 | Ritzer | |
| 2008/0092473 | A1 * | 4/2008 | Heyns | 52/385 |

* cited by examiner

*Primary Examiner* — Mark Wendell
(74) *Attorney, Agent, or Firm* — Nixon & Vanderhye P.C.

(57) ABSTRACT

A pre-fabricated tile system includes modular backing boards comprising a plurality of tile backing board units including male/female edges for mating with an adjacent unit and a protruding bump serving as a grout spacer.

20 Claims, 12 Drawing Sheets

PREFABRICATED TILE SYSTEM WITH MODULAR BACKING BOARD

CROSS-REFERENCE TO RELATED APPLICATIONS

This application claims priority to U.S. Provisional Application Ser. No. 61/691,418, filed Aug. 21, 2012, which is hereby incorporated herein by reference in its entirety.

TECHNICAL FIELD

The present technology relates generally to tile assemblies, and more particularly to prefabricated tile assemblies.

BACKGROUND

Most tile installations are performed on site, requiring skilled, experienced professionals. In addition to being costly and time consuming, the installation involves the use of many materials, usually leaving a mess to be cleared up.

SUMMARY

One exemplary pre-fabricated tile system uses a modular backing board. The system includes a plurality of the modular tile backing board units, preferably formed of an extruded plastic, serving as an installation surface for tiles (e.g., ceramic, porcelain, stone, etc.). The backing board units are intended to replace drywall, green board, cement board, etc. normally used in house construction. Each unit includes a male connecting portion (tongue) at its bottom edge and a relatively deep (preferably non-symmetrical) mating female connecting portion (groove) at its top edge such that one lower/upper unit can be firmly connected to an adjacent upper/lower unit. Near the male connecting tongue portion, a protruding bump or ledge extends horizontally and (a) functions to help support the weight of the tile (in vertical installations before the mortar has cured) while (b) also serving as a horizontal grout line spacer. The height of the unit and the position of the bump/ledge/spacer are selected to match the tile height (or multiple tile heights plus their respective grout spacings if plural tile rows are used).

The female groove connecting portion has two extending sidewall portions with a groove space provided therebetween. A rear extending sidewall portion preferably extends further upwards than a front sidewall portion to provide space to connect (e.g., by screwing) this portion of the backing board units into the wall studs (or floor joists, or boards if a floor surface is involved). The farther extending rear sidewall portion may also help prevent water from infiltrating to the rear of the installed assembly since any moisture that passes through the grout seam must also travel upwardly over the rear sidewall to reach the rear of the assembly.

The backing board units (and already affixed tiles) may be installed at the work site from the floor (or bottom of the work site, or edge of the work site for floor or ceiling installations) to the top (or opposing side) by positioning the male tongue connecting portion of the upper unit over into the female groove connecting portion of the lower installed unit. Once the units have been installed (which can be from the floor to ceiling in a one-day installation process if desired because the tiles are preferably already cemented to the backing boards and thus cumulative weight of vertically stacked tiles on still wet cement is not an issue), any remaining grout work can be completed by less skilled workers.

The backing board units and their already affixed tiles may be pre-fabricated at mass manufacturing facilities. The lengths and/or widths of the units can be pre-sized to typical work site expectations (e.g., for standard bathtub, shower or kitchen counter/cabinet installations). By this procedure, once the pre-fabricated units reach the work site, they may simply be screwed into wall studs (or floor joists or boards if a floor installation is involved) and grout (or added grout) as needed may be applied thereafter. The pre-fabricated units may also be removed and reused with minimal effort and damage only to the grout.

Alternatively, the tiles may be applied to the backing board units after installing the bare units on the floor, wall, etc.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this technology. In such drawings.

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

Figure 1:
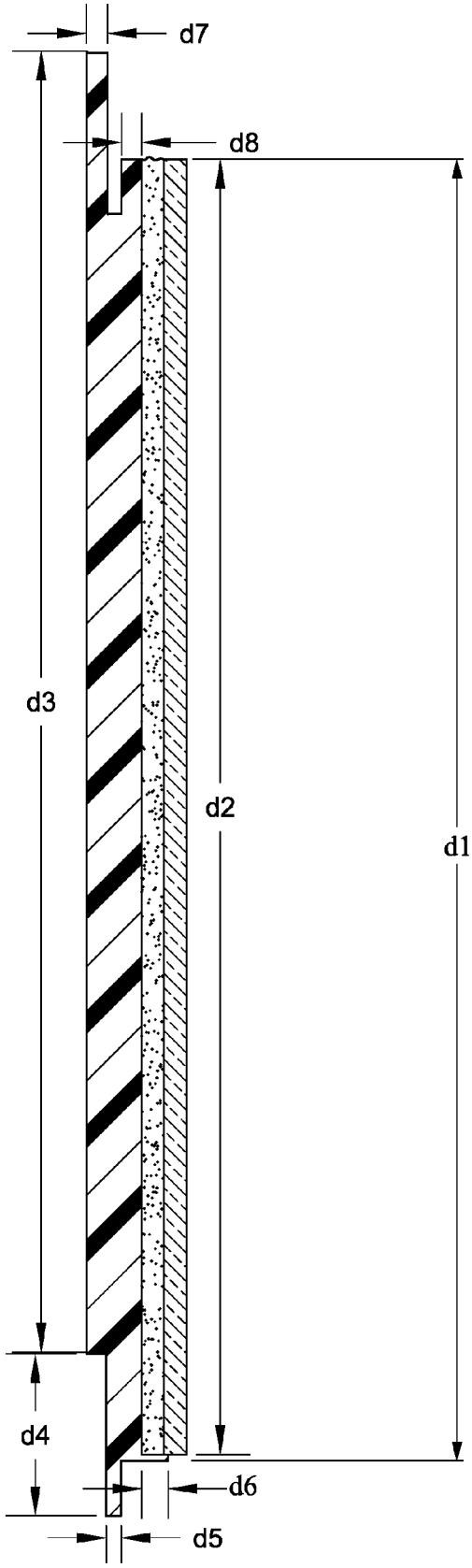
FIG. 1 is a cross-sectional view of an example backing board.
Figure 2:
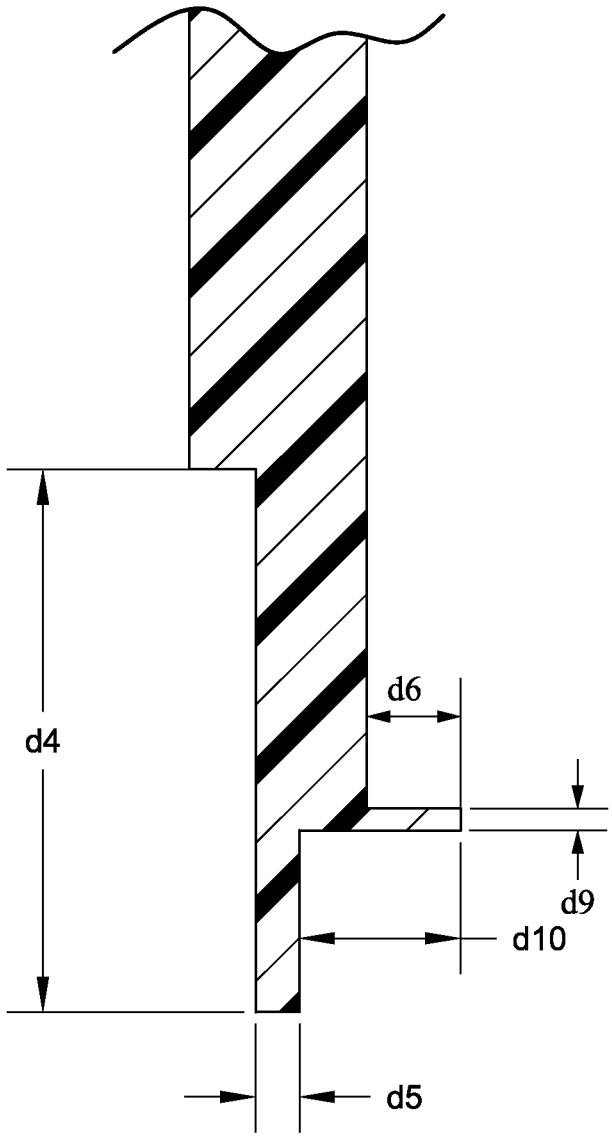
FIG. 2 is a cross-sectional view of a tongue connector portion of the backing board of FIG. 1.
Figure 3:
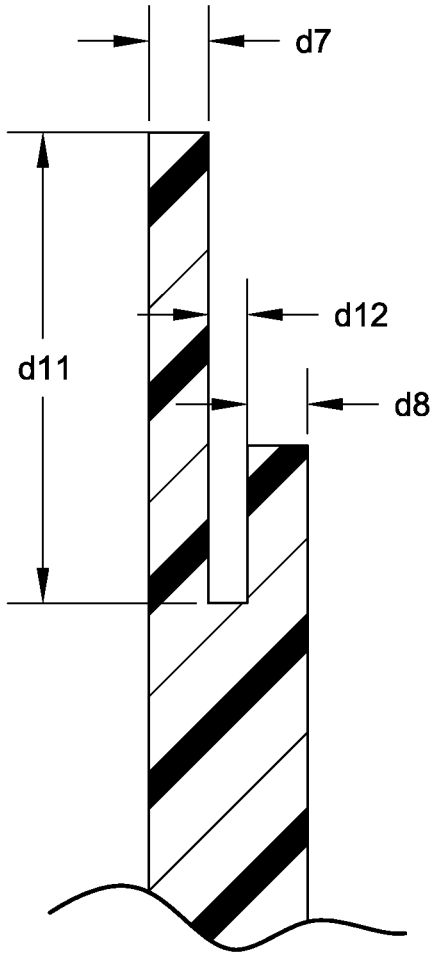
FIG. 3 is a cross-sectional view of a groove connector portion of the backing board of FIG. 1.
Figure 4:
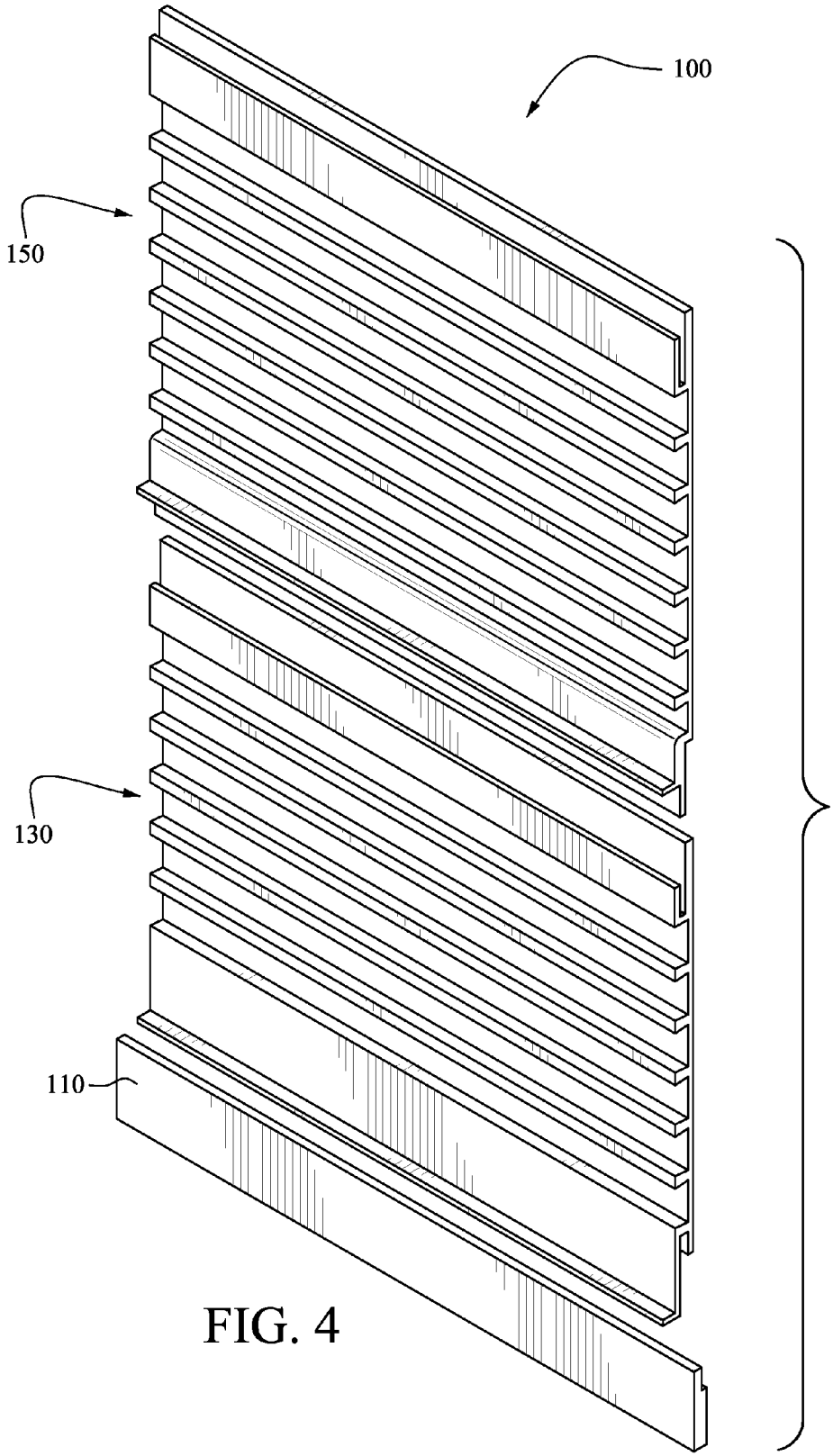
FIG. 4 is an exploded perspective view of an example tile backing board assembly.
Figure 5:
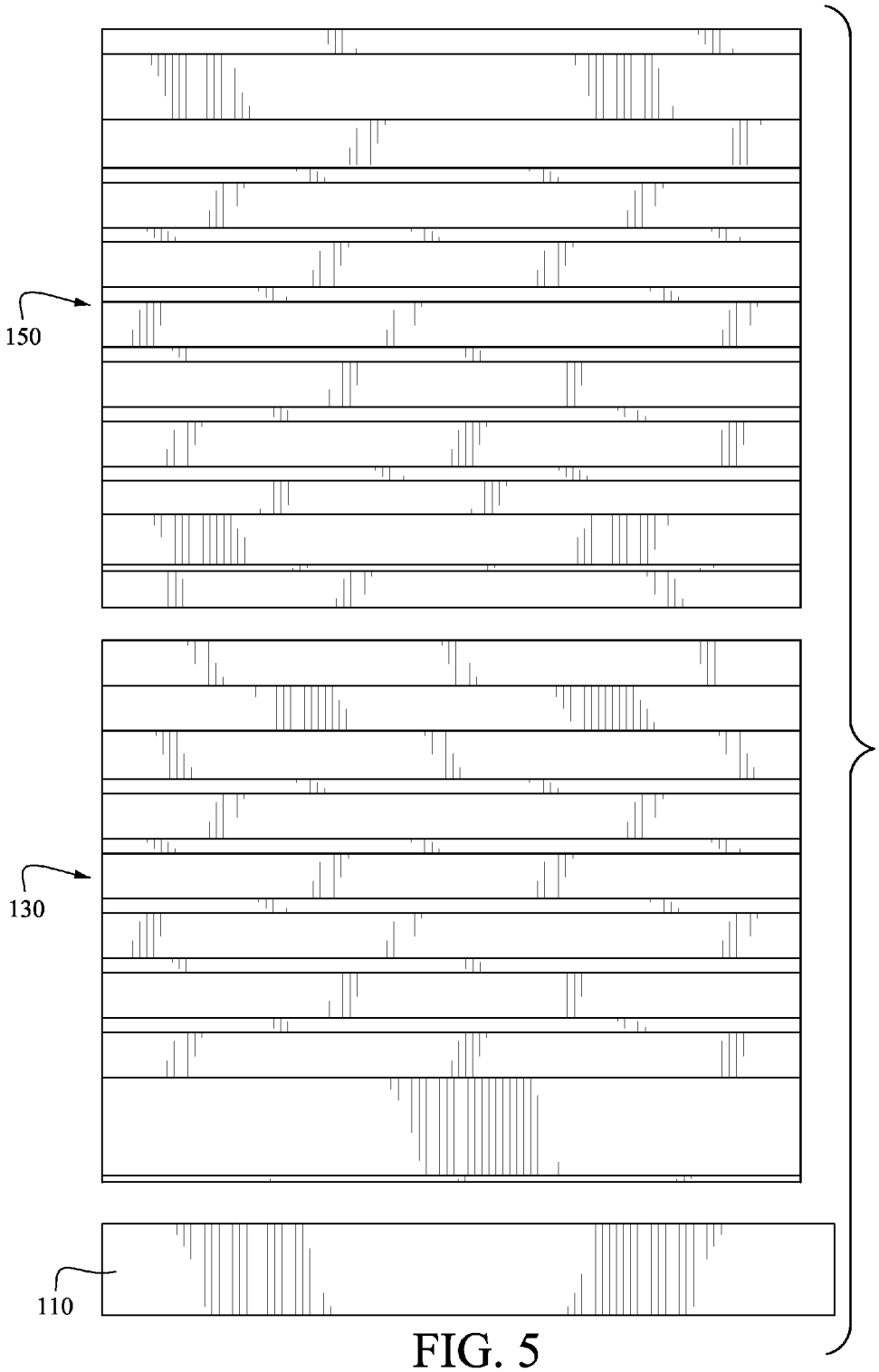
FIG. 5 is an exploded front view of the tile backing board assembly of FIG. 1.
Figure 6:
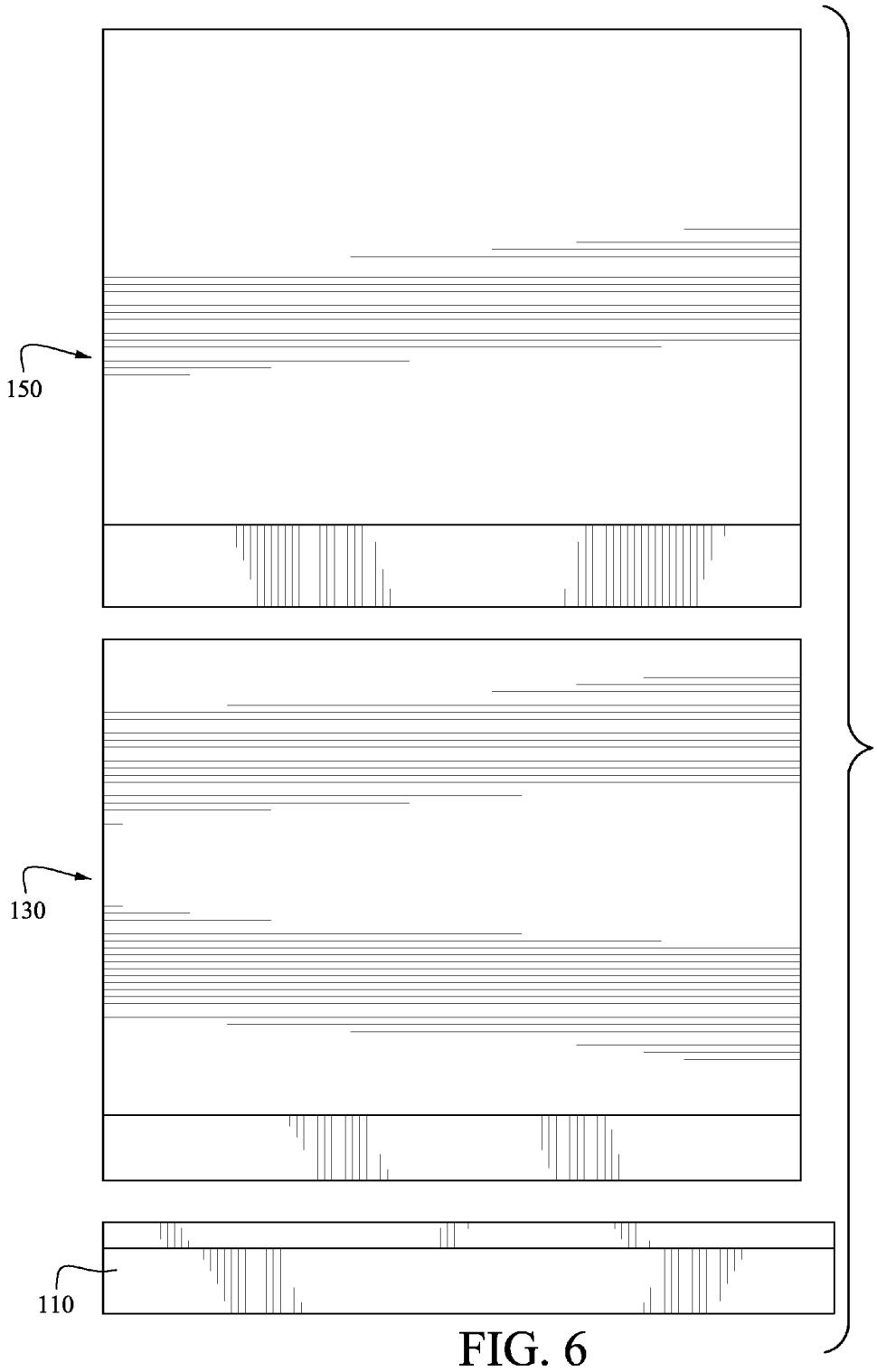
FIG. 6 is an exploded rear view of the tile backing board assembly of FIG. 1.
Figure 7:
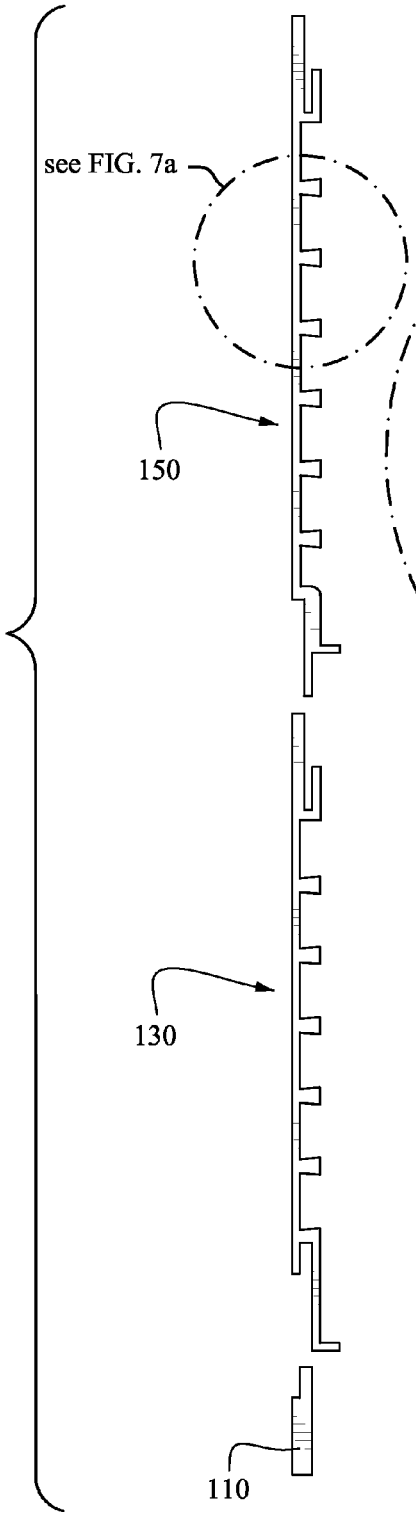
FIG. 7 is an exploded side view of the tile backing board assembly of FIG. 1.
Figure 7A:
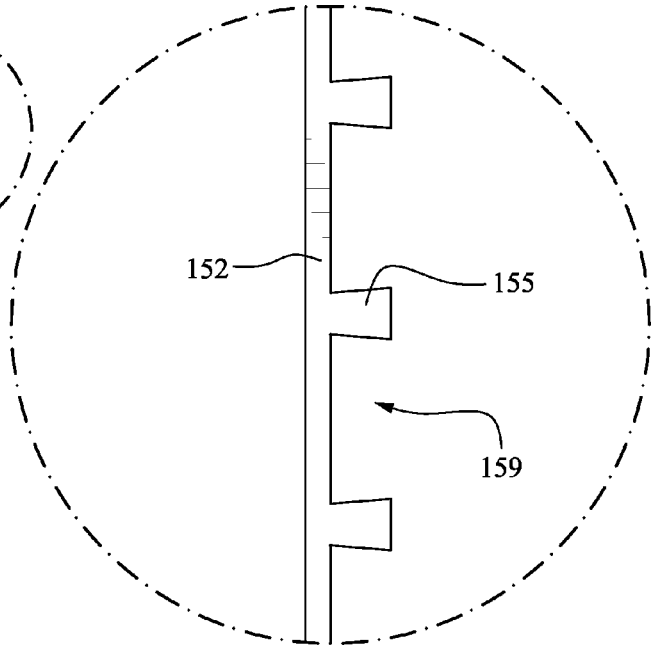
FIG. 7*a* is an enlarged detail of FIG. 7.

Referring to FIGS. 1-3, shown are cross-sectional views of a backing board unit (and an affixed tile) according to an example of the disclosed technology. It is noted that the dimensions included in the figures merely represent an example of the disclosed technology and one skilled in the art will recognize that the backing board units may be configured to have other dimensions.

The distance d1 represents the height of the backing board unit from the grout line bump to the edge of the front side wall portion of the groove connection portion. Although only one grout line bump is shown, it is noted that plural grout line bumps may be provided along the height of the board unit so as to accommodate plural rows of tiles. Accordingly, d1=T(a)+G(a), where T is the vertical height of one tile, a is the number of vertically arranged tiles, G is the vertical height of one grout line bump (i.e. the grout line dimension). It is also noted that each row of tiles may have a different vertical height such that d1 equals the sum of the tile heights plus the sum of the grout line bump heights (the grout line bump/edge/spacer may have any suitable vertical height d9). A typical grout line spacing or vertical height d9 for a tile having a vertical height of 1 foot may be 1/16 inch, for example. In the illustrated example shown in FIGS. 1-3, d1 may be 1'1/16", d2 may be 1', d3 may be 1'1/16", d4 may be 1'1/2", d5 may be 1/8", d6 may be 1/4", d7 may be 3/16", d8 may be 3/16", d9 may be 1/16", and d10 may be 7/16".

Additionally, the grout line bump/edge/spacer may have any suitable horizontally (outwardly) extending dimension (depth). Further, the grout line bump may extend continuously across the width of the backing board unit, or the grout line bump may extend across the width of the backing board unit in an interrupted manner.

This system is an improved system for tiling, adaptable for use on floors, walls, ceilings and other tiled surfaces. The modular backing board units (or substrates) replace drywall, green board, cement board and other substrates currently used in wet and dry surfaces. The substrates can be manufactured without the tiles pre-installed such that the substrates are installed directly onto the application surface (e.g, wood or metal framing/studs) and tiles are subsequently installed thereon (e.g., in a vertical position for wall installation). Alternatively, the substrates can be created with permanent-factory installed tiles affixed thereon prior to attaching the substrates to the studs, the existing drywall, or any other suitable installation surface.

The interlocking tile substrates are preferably made of plastic; however, other suitable rigid or semi-rigid materials may be used (e.g., fiberglass). The interlocking design consists of panels, manufactured to specified lengths.

The interlocking system may include:

1) A "lock and key" system that allows substrates (or panels) to interlock and stack, covering an entire surface (e.g., floor to ceiling).
2) A "guide" system consisting of precisely measured protrusions that keep tiles in place with a calculated depth to allow for grout installation.

Each substrate (or panel) may be provided: 1) covered with tiles or without tiles; 2) pre-drilled for screws in order to hang the panel where the holes are spaced at intervals that account for all standard framing or any other desired interval; and 3) with a finger joint corner system for ensuring a waterproof and stable installation at the corners.

The height of the panels may be based on any tile height or the most frequently manufactured popular tile sizes, e.g., 12", 18" and 24". In standard 3 ft×5 ft bathroom enclosures, for example, the lengths of the panels manufactured are 3 ft and 5 ft, respectively. For this situation, fifteen (15) panels are manufactured: five 5 ft panels and ten 3 ft panels, all to a specified height of 1'/12". Therefore, an entire three-walled enclosure may be covered with 15 interlocked panels. These panels are designed to accommodate 12×12 tiles, in this example. An added feature creates a finger joint corner system (where panels installed on a first wall interface with panels installed on a second wall that is disposed at an angled with respect to the first wall) for ensuring a waterproof and stable installation. In this example, an estimated 55 square feet of total tile is required.

The designs in today's market are increasingly moving towards maintenance free materials, which means minimum amount of grout between tiles. This implies bigger tiles, not only preferable from a design standpoint but from a maintenance standpoint, using less grout and leading to less maintenance. A disadvantage of larger tiles is that they are heavier and thicker and thereby more difficult and time consuming to install.

The unique design of the disclosed system, particularly with today's larger, rectified tiles in mind, allows for a guide for tiles and for grout lines, creating a more precise install, regardless of tile size.

Further, rather than paying a highly skilled tile and ceramic installer to install tiles, the disclosed system provides for substrates having factory pre-installed tiles affixed thereon. This allows an unspecialized laborer to install the substrate (and affixed tiles) (e.g., on a horizontal or vertical surface), with built-in guides.

The interlocking, self-guiding system allows for any tiles to be factory installed.

Meanwhile, the system is environmentally friendly and conservative. The process of changing tiles not only allows for a cleaner demolition process but allows for conservation of the tiles and substrates. In fact, installed tiles can be recycled. Change-out is simply a matter of removing the grout on the very top part of the installed tile, removing the screws, for example, on the panel and pulling the panel out to remove the second boards and screws, and so on, until all boards are removed. This system obviates hammering and dusty demolition work and the removed boards can be installed on any other desired surface.

Some example tile (e.g., ceramic) applications include a pre-defined system, for example, for standard 3'×5' enclosures (e.g., bathroom enclosures) in American homes since they are so common. This may be a pre-fab system that takes the standard 3×5 dimensions into account.

An example of the disclosed technology includes a pre-fabricated shower system with tiles and shower pan pre installed. In this system, the panels are made for a shower and also have an extension that interlocks with the shower pan on the floor and the system is provided "pre-ready" having tile all over it and provided pre-fabricated, ready to go. The shower pan may be provided by one or more of the panels which may be covered with tile, coated, or otherwise provided with a suitable surface. The panel(s) forming the shower pan may have a mechanical connection (e.g., interlocking fingers, tongue and groove, snap-fit, interference, dove-tail, etc.) to the panels forming the wall structure.

Pre-fabricated lengths may also be provided for custom applications, such as custom showers and baths, custom floors and custom walls.

For entire bathrooms or cruise ships, you could have units that include the shower and also have the floor and walls tiled to create a pre-fabricated bathroom with tiles installed and plumbing holes pre-drilled so all a user would have to do is set it in place, and install vanity, toilet and plumbing fixtures. In a boat or multi unit project such as system could be really efficient.

This system may also be used for exterior applications.

The method of installing the panels, for example, relies of screws, pre-drilled to a defined depth and located at the interface between the panels. This design for the screw holes is spaced based on assumptions/calculations regarding the standard 16" and 24" spaces between studs. However, the screw holes may have any suitable spacing. The panels may also have a recessed portion surrounding the holes such that the installed screws lie flush with the panel surface. Further, the panels may be provided without screw holes so that the user may determine the optimum location to insert screws.

Figure 13:
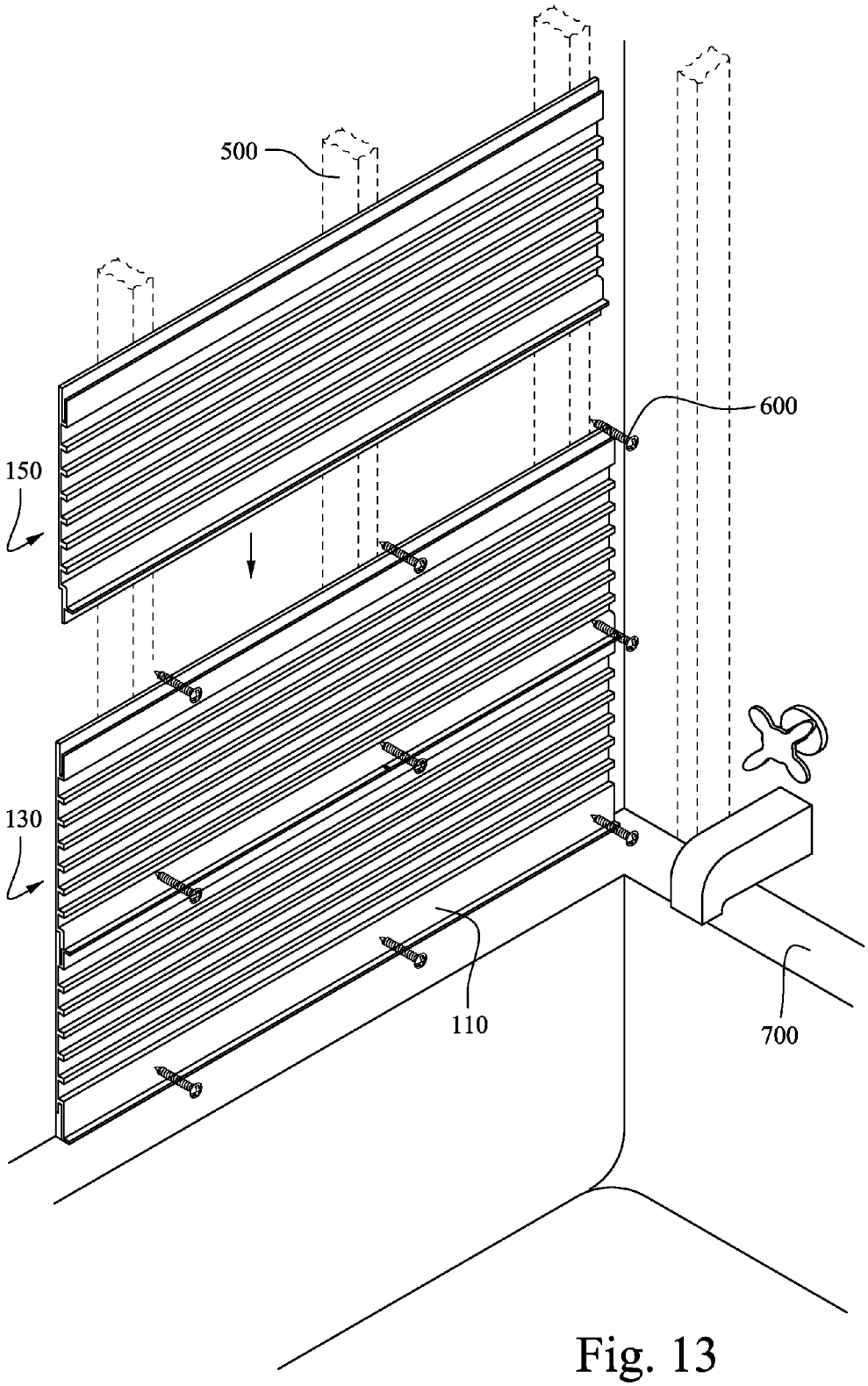
FIG. 13 is a perspective view of an example installation of the tile backing board assembly of FIG. 1; and, FIG. 13-1 is a perspective view of an example installation of a tile backing board according to another example of the disclosed technology.
Figures 1, 13:
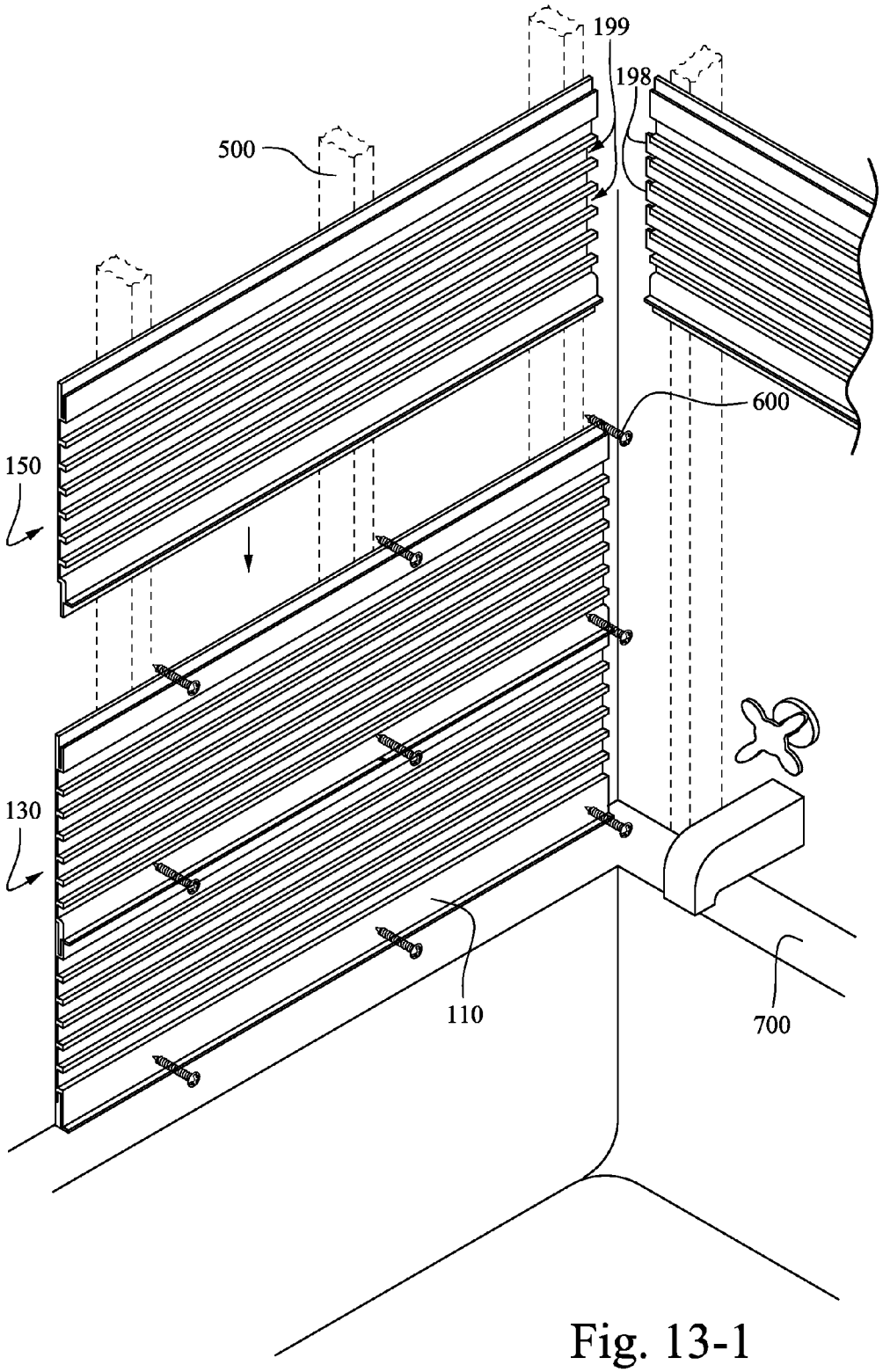

The interface at corners, for example in 3'×5' shower enclosures, where the 5' side meets the 3' side, may include a mechanical connection (e.g., a finger joint interlocking system 198, 199, dove-tail connection, etc). The finger joint system may include a series of alternating protrusions 198 and spaces on a first panel which interlock with a similar set of alternating protrusions and spaces 199 on a second panel, where the second panel interfaces with the first panel at a corner or angle, such as shown in FIG. 13-1.

A horizontal interlocking system may be provided. It may be more efficient and visually pleasing to have the interlocking system lock side-to-side rather than top-to-bottom. For instance, the tongue and groove connectors may be provided on the lateral sides of the panels rather than the top/bottom. The grout line bump may also be provided on the lateral sides of the panel.

In another example, connectors may be provided on the lateral sides as well as the top/bottom of the panel. Such configuration may be conducive to large install areas (e.g., large floor areas) where each panel will likely connect to an adjacent panel on more than one side. Similarly, the grout line bump may also be provided on both the lateral sides and the top/bottom of the panel as this may provide more support for larger tiles.

In another example, connectors and grout line bumps may be provided on lateral sides of the panels, and the panels may have their top and/or bottom sides angled such that the panels may be installed diagonally (e.g., to provide a "diamond" tile layout). By this arrangement, the angled top and/or bottom sides may allow the panels to evenly abut against an edge (e.g., wall, floor, tub) of the work area.

The grout line bumps may be flat, round, triangular or any other suitable shape.

The panels may have varying heights such that a first panel has, for example, 12" tile and an abutting panel has a different size tile (e.g., 4" tile) such that a variety of designs may be provided. Particularly, at the border of the tile area, a smaller panel (and smaller tile) may be provided.

The panels may be made from fiberglass or various plastics, including high density polyurethane (HDPE), however other composite materials including plastics, cement-based, etc may be used. Those skilled in the art will recognize that other material may also be used. The panels also may be made from recycled materials.

Referring to FIGS. 4-7, tile backing board assembly 100 including a variety of tile backing boards is shown. The assembly includes edge board 110, starter board 130, and primary backing board 150. Edge board 110 may be installed at the bottom or edge of an installation area. An installer may use a leveler to ensure that edger board 110 is connected to the work surface or area in a level manner. Starter board 130 is configured to connect to edge board 110 and primary backing board 150 is configured to connect to starter board 130. Primary backing board 150 has mating connectors at its opposite ends such that a series of primary backing boards 150 may be stacked one on top of another.

Figure 8:
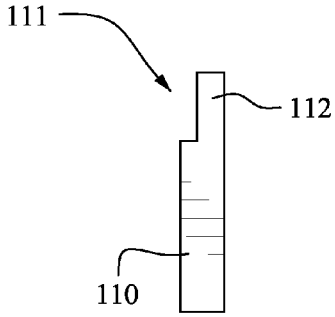
FIG. 8 is a side view of an example edge board of the tile backing board assembly of FIG. 1.

As shown in FIG. 8, edge board 110 includes notch 111 and protrusion 112. Starter board 130 includes connector 140 at an end portion thereof, a shown in FIG. 9. Connector 140 includes first leg 142 and second leg 144 which define groove 146. Groove 146 is configured to receive protrusion 112 on edge board 110. First leg 142 of connector 140 is configured to be received in notch 111 of edge board 110. Ledge 148 extends from second leg 144 and is configured to support the edges of tiles installed on starter board 130.

Figure 9:
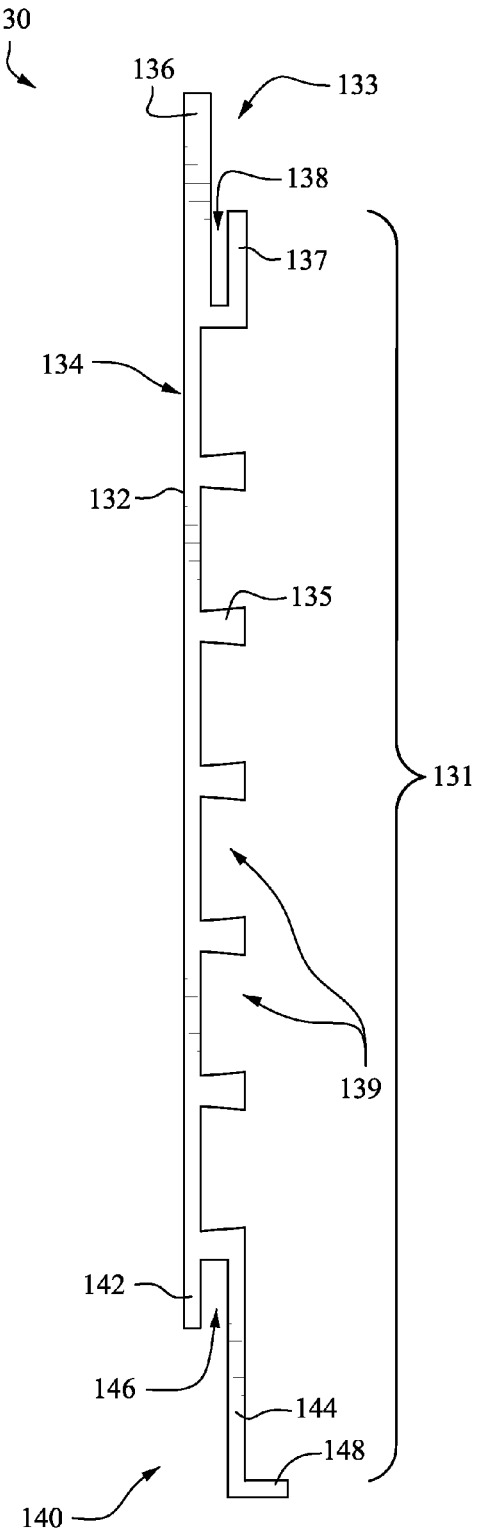
FIG. 9 is a side view of an example starter board of the tile backing board assembly of FIG. 1.

Still referring to FIG. 9, starter board 130 includes a body portion 132 having a rear surface 134 arranged to be installed against the surface (e.g., flooring) or structure (e.g., studs) to be covered with tile. A plurality of projections 135 extend from body portion 132. The provision of projections 135 creates recessed areas 139 which reduce the weight of the starter board.

Starter board 130 includes connector (e.g., groove connector) 133, as shown in FIG. 9. Connector 133 includes first leg 136 and second leg 137 which define groove 138. Groove 138 is configured to receive connector 160 of primary backing board 150, as shown in FIG. 10.

Starter board 130 includes a tile receiving portion 131 for receiving tiles thereon extending between ledge 148 and an end portion of second leg 137. A bonding agent may be applied to tile receiving portion 131 so as to cover projections 135. Projections 135 may have a wedge shape which may provide a mating interlocking type connection with the cured bonding agent which may enhance the connection between the tile and starter board 130.

Figure 10:
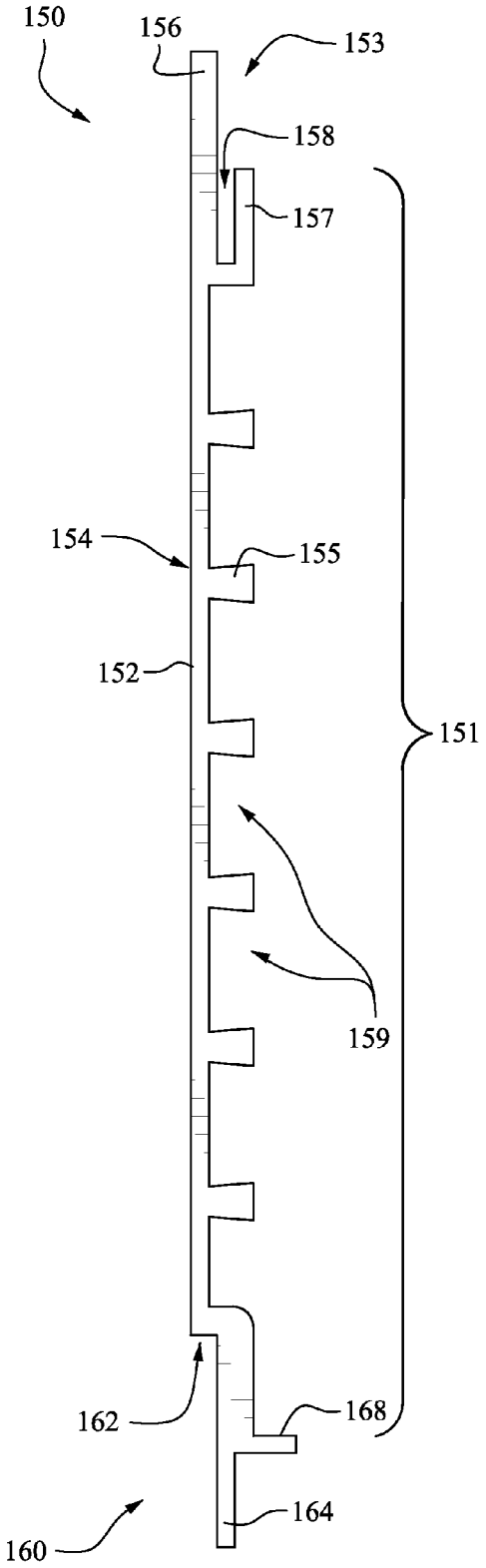
FIG. 10 is a side view of an example primary backing board of the tile backing board assembly of FIG. 1.

As shown in FIG. 10, connector (e.g., tongue connector) 160 of primary backing board 150 includes a notch 162 and a tongue 164. Connector 160 is configured to mate with connector (e.g., groove connector) 153 disposed at an opposite end of primary backing board 150. Connector 153 and connector 160 may form a tongue-and-groove connection. This arrangement allows a series of primary backing boards to be stacking one on top of the other.

Notch 162 is configured to receive first leg 156 and tongue 164 is configured to be inserted into groove 158 which is defined by first leg 156 and second leg 157, as can bee seen in FIG. 10. Grout line spacer (e.g., ledge) 148 extends from or from an area adjacent tongue 164 and is configured to support the edges of tiles installed on primary backing board 150. Primary backing board 150 may include any number of grout line spacers thereon so as to support a plurality of tiles (or rows of tiles) across tile receiving portion 151.

Referring to FIGS. 9 and 10, groove connector 133 of starter board 130 may be similar or identical to groove connector 153 of primary backing board 150 such that tongue connector 160 of primary backing board 150 may form a mating connection with either groove connector (133, 153).

Primary backing board 150 is similar to starter board 130 in that it also includes a body portion 152 having a rear surface 154 arranged to be installed against the surface (e.g., flooring) or structure (e.g., studs) to be covered with tile. A plurality of projections 155 extend from body portion 152. The provision of projections 155 creates recessed areas 159 which reduce the weight of the primary backing board.

Primary backing board 150 includes a tile receiving portion 151 for receiving tiles thereon extending between grout line spacer 168 and an end portion of second leg 157. A bonding agent may be applied to tile receiving portion 151 in the same manner described above with regard to tile receiving portion 131.

The heights of tile receiving portion 131 and tile receiving portion 151 preferably correspond to a height of an integer number of tiles (e.g., a single tile). In this manner, tiles may be pre-installed on starter board 130 and primary backing board 150 without the need for any tile to extend between boards.

Figure 11:
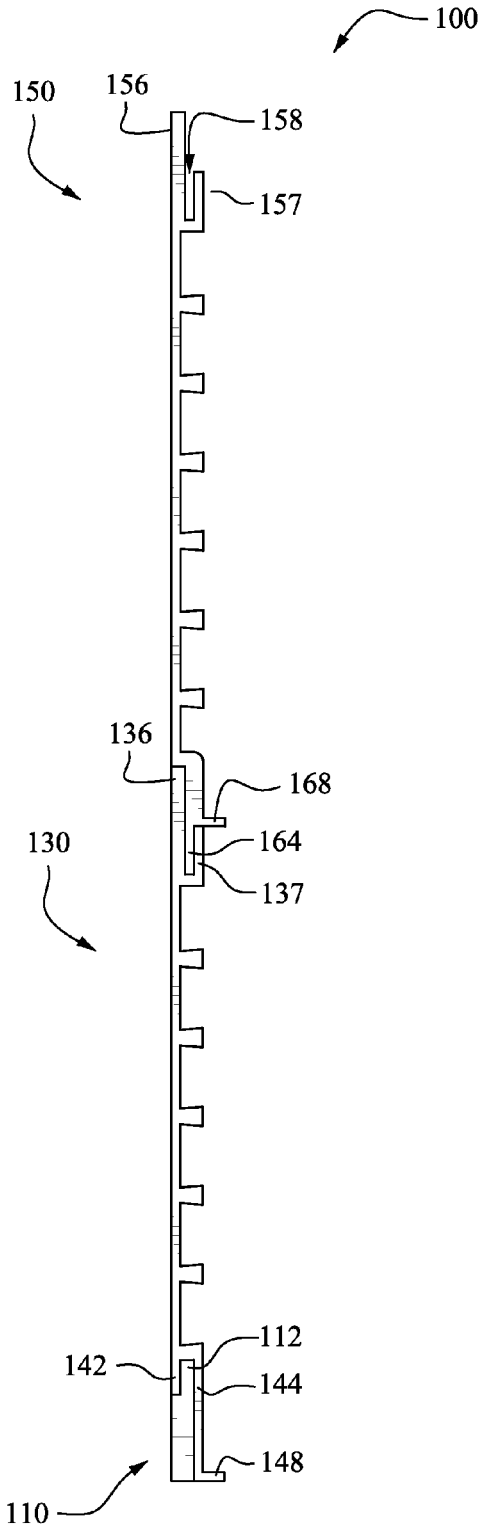
FIG. 11 is a side view of the tile backing board assembly of FIG. 1.
Figure 12:
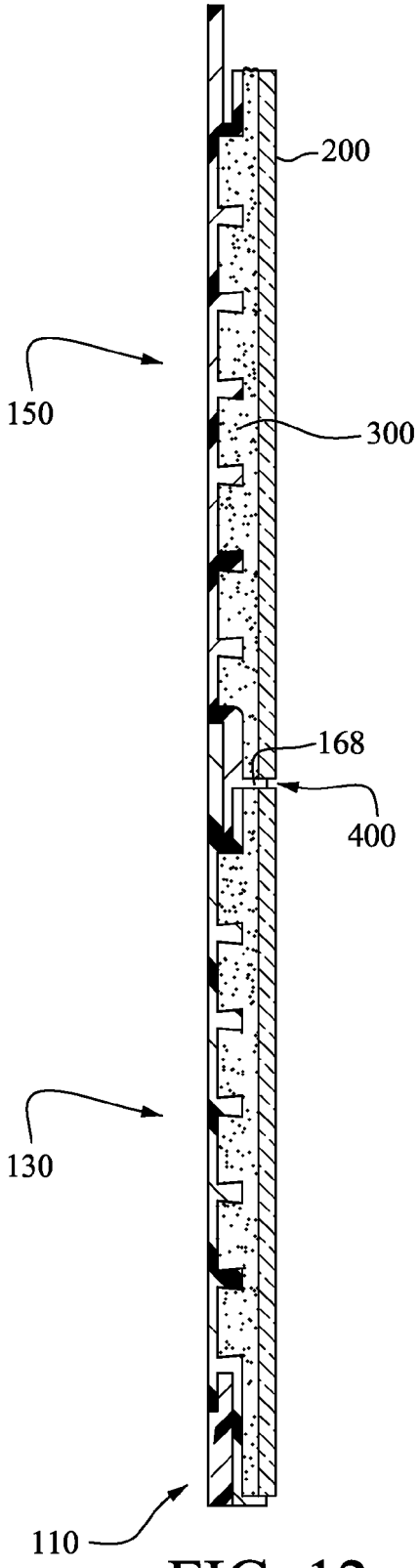
FIG. 12 is a side view of the tile backing board assembly of FIG. 1 having tiles affixed thereon.

The mating connections between edge board 110, starter board 130 and primary backing board 150 are shown in FIG. 11. As shown in FIG. 12, tiles 200 may be installed on starter board 130 and primary backing board 150 with bonding agent 300. A grout line or space 400 is provided over grout line spacer 168.

Turning to FIG. 13, an installation of edge board 110, starter board 130 and primary backing board 150 above a bathtub 700 is illustrated. Edge board 110, starter board 130 and primary backing board 150 may be installed on mounting members (e.g., studs) 500 with fasteners (e.g., screws) 600.

While the examples discussed above have been described in connection with what are presently considered to be practical and preferred features, it is to be understood that appended claims are intended to cover modifications and equivalent arrangements included within the spirit and scope of these examples.

What is claimed is:

1. A tile receiving structure, comprising:

a tile receiving portion configured to receive an integer number of tiles;

a first connector arranged at a first side portion of the tile receiving portion;

a second connector arranged at a second side portion of the tile receiving portion, the second side portion being opposite the first side portion, the second connector being configured to connect to the first connector of an adjacent tile receiving structure; and at least one ledge protruding from the tile receiving portion and arranged to provide a space between installed tiles extending on opposite sides thereof, said space providing a grout line, wherein third and fourth opposing side portions of the tile receiving portion are without a connector feature for connection to an adjacent tile receiving structure.

2. The tile receiving structure of claim 1, wherein the first connector includes a tongue.

3. The tile receiving structure of claim 2, wherein the second connector includes a groove.

4. The tile receiving structure of claim 3, wherein the second connector includes a rear leg and a front leg which define the groove, and the rear leg protrudes further from the tile receiving portion than the front leg.

5. The tile receiving structure of claim 4, wherein the first connector includes a notch configured to receive the rear leg of the second connector of an adjacent tile receiving structure.

6. The tile receiving structure of claim 4, wherein the rear leg of the second connector is configured to receive a fastening member to attach the tile receiving structure to an installation support.

7. The tile receiving structure of claim 1, further comprising a body portion, wherein the tile receiving portion includes a plurality of projections extending from the body portion and a plurality of recessed areas between the projections.

8. The tile receiving structure of claim 1, wherein the first and second side portions are arranged to be disposed, respectively, on top and bottom sides of the tile receiving portion when the tile receiving structure is installed.

9. A tile receiving structure, comprising:

a tile receiving portion configured to receive an integer number of tiles;

a first connector arranged at a first side portion of the tile receiving portion;

a second connector arranged at a second side portion of the tile receiving portion, the second side portion being opposite the first side portion, the second connector being configured to connect to the first connector of a first adjacent tile receiving structure; and a third connector arranged at a third side portion of the tile receiving portion, the third connector being arranged to connect with a mating connector of a second adjacent tile receiving structure, wherein the receiving portion extends substantially perpendicularly to the second adjacent tile receiving structure such that the third connector connects the tile receiving structure to the second adjacent tile receiving structure at a corner formed therebetween.

10. The tile receiving structure of claim 9, wherein at least one ledge protrudes from the tile receiving portion and is arranged to provide a space between installed tiles extending on opposite sides thereof, said space providing a grout line.

11. The tile receiving structure of claim 9, wherein the third connector includes a plurality of finger portions.

12. The tile receiving structure of claim 9, wherein the first connector includes a tongue.

13. The tile receiving structure of claim 12, wherein the second connector includes a groove.

14. The tile receiving structure of claim 13, wherein the second connector includes a rear leg and a front leg which define the groove, and the rear leg protrudes further from the tile receiving portion than the front leg.

15. The tile receiving structure of claim 14, wherein the first connector includes a notch configured to receive the rear leg of the second connector of an adjacent tile receiving structure.

16. The tile receiving structure of claim 14, wherein the rear leg of the second connector is configured to receive a fastening member to attach the tile receiving structure to an installation support.

17. The tile receiving structure of claim 9, wherein the first and second side portions are arranged to be disposed, respectively, on top and bottom sides of the tile receiving portion when the tile receiving structure is installed.

18. A pre-fabricated tile system, comprising;

at least one first backing board including a first tile receiving portion configured to receive a plurality of tiles, the first backing board including a first connector arranged at a first side portion thereof and a second connector arranged at a second side portion thereof, the second side portion being opposite the first side portion of the first backing board such that the second connector is configured to connect to the first connector of an adjacent tile receiving structure;

at least one second backing board including a second tile receiving portion configured to receive a plurality of tiles, the second backing board including a first connector arranged at a first side portion thereof and a second connector arranged at a second side portion thereof, the second side portion of the second backing board being opposite the first side portion of the second backing board such that the second connector of the second backing board is configured to connect to the first connector of an adjacent tile receiving structure;

a first set of tiles installed on the first tile receiving portion in side-by side arrangement along a length of the first backing board;

a second set of tiles installed on the second tile receiving portion in side-by side arrangement along a length of the second backing board, wherein the first backing board has a length that is different than a length of the second backing board.

19. The pre-fabricated tile system of claim 18, wherein the first connectors of the first backing board and the second backing board include a tongue and the second connectors of the first backing board and the second backing board include a groove.

20. The pre-fabricated tile system of claim 19, wherein the first backing board includes a third connector arranged at a third side portion thereof, the third connector being arranged to connect with a mating connector of second backing board at a corner formed by the first and second backing boards.

* * * * *